US007628741B2

(12) United States Patent
Adcock et al.

(10) Patent No.: US 7,628,741 B2
(45) Date of Patent: Dec. 8, 2009

(54) EXERCISE DEVICE AND METHOD

(76) Inventors: Danny Leonard Adcock, 33 Crystal Street, Petersham, NSW (AU) 2049; Jennifer Stephanie Adcock, 33 Crystal Street, Petersham, NSW (AU) 2049

( * ) Notice: Subject to any disclaimer, the term of this patent is extended or adjusted under 35 U.S.C. 154(b) by 314 days.

(21) Appl. No.: 10/537,240

(22) PCT Filed: Nov. 26, 2003

(86) PCT No.: PCT/AU03/01576

§ 371 (c)(1),
(2), (4) Date: May 9, 2006

(87) PCT Pub. No.: WO2004/050192

PCT Pub. Date: Jun. 17, 2004

(65) Prior Publication Data

US 2006/0270534 A1 Nov. 30, 2006

(30) Foreign Application Priority Data

Dec. 5, 2002 (AU) ..... 2002953176

(51) Int. Cl.
*A63B 21/02* (2006.01)
*A63B 21/05* (2006.01)

(52) U.S. Cl. ..... 482/122; 482/124; 482/128

(58) Field of Classification Search ..... 482/111, 482/112, 122, 124, 128, 905; 601/33; 602/16
See application file for complete search history.

(56) References Cited

U.S. PATENT DOCUMENTS 3,174,343 A * 3/1965 Kasulis ..... 482/112
4,834,366 A * 5/1989 Hotchkiss ..... 482/122
4,951,941 A * 8/1990 Resk ..... 482/112
5,403,269 A * 4/1995 Kennedy ..... 602/36
5,462,518 A * 10/1995 Hatley et al. ..... 602/36
5,501,646 A * 3/1996 Miller ..... 482/11
5,643,160 A * 7/1997 Huang ..... 482/126
5,749,810 A * 5/1998 Fenstermaker ..... 482/57
6,245,034 B1 * 6/2001 Bennett et al. ..... 602/20
6,569,067 B1 * 5/2003 Madole ..... 482/148
D519,587 S * 4/2006 McCarty et al. ..... D21/692
2005/0255974 A1 * 11/2005 Gault ..... 482/111

* cited by examiner

*Primary Examiner*—Loan H Thanh
*Assistant Examiner*—Allana Lewin

(57) ABSTRACT

A device for the exercise of the musculature of the upper arm, the device comprising: telescopically assembled co operating inner and outer tubular elements, each said tubular elements having end closure means at their outer ends. The outer tubular element includes an inwardly projecting collar at its inward open end and the inner tubular element is provided with an outwardly projecting collar at its inward open end. The collars co operate to prevent the withdrawal of the inner tubular element from the outer tubular element when the tubular elements operate telescopically. The device is moveable between a first state in which the telescopic elements are fully extended and a second state in which the telescopic elements are compressible against a bias inside the device to provide a resistance force to rotational movement about the elbow of a forearm in a direction towards an upper arm of the same arm of a user. The device is of a size which allows engagement of one end with a hand of a user and the other end with an upper part of the same arm such that the user can exercise one arm without use of the other arm.

17 Claims, 4 Drawing Sheets

EXERCISE DEVICE AND METHOD

BACKGROUND

The present invention relates to a compression exercise device for the development or rehabilitation of the musculature of the upper arm. The invention also relates to a method of use of an exercise device which is tailored to suit the exercise of an arm without using the other arm.

PRIOR ART

The desire to increase the muscle tone and muscular capacity of the body and specific parts of the body have led to the development of a large range of equipment designed to aid in that process. Such equipment includes weights; stretchable spring arrays and highly complex so-called exercise machines. The development of the muscles of the arm, in particular the biceps, has generally required the use of weights. These are bulky and inconvenient in many situations and do not allow a specifically useful means and method of exercise in which the range of pivotal movement of the forearm relative to the upper arm is restricted to an angle less than 90 degrees.

BRIEF DESCRIPTION OF INVENTION

The present invention seeks to address the aforesaid prior art disadvantages or at least provide a useful alternative.

The invention provides an exercise device for the exercise of the musculature of the upper arm and to provide a resistance force to rotational movement about the elbow of the forearm towards the upper arm allowing for rotational movement between the limits of approximately an angle of 90 degrees at the elbow and an angle between the forearm and upper arm limited by contact between the forearm and upper arm.

According to one embodiment, the device comprises telescopically assembled inner and outer tubular elements, provided with end closure means at outer ends of said tubular elements; said outer tubular element provided with an inwardly projecting collar at its inward open end; said inner tubular element provided with an outwardly projecting collar at its inward open end; said collars adapted to prevent the withdrawal of said inner tubular element from said outer tubular element when said tubular elements are telescopically assembled.

In its broadest form the present invention comprises:

a device for the exercise of the musculature of the upper arm, the device comprising: telescopically assembled co operating inner and outer tubular elements, each said tubular elements having end closure means at their outer ends; said outer tubular element including an inwardly projecting collar at its inward open end; said inner tubular element provided with an outwardly projecting collar at its inward open end; said collars co operating to prevent the withdrawal of said inner tubular element from said outer tubular element when said tubular elements operate telescopically; said device moveable between a first state in which the telescopic elements are fully extended and a second state in which the telescopic elements are compressible against a bias inside the device to provide a resistance force to rotational movement about the elbow of a forearm in a direction towards an upper arm of the same arm; wherein the device is of a size which allows engagement of one end with a hand of a user and the other end with an upper part of the same arm such that the user can exercise one arm without use of the other arm.

Preferably the rotational movement extends between the limits of approximately an angle of 90 degrees formed by the forearm and upper arm and a smaller angle between said forearm and said upper arm limited by contact between said forearm and said upper arm. The bias is a compression spring which naturally biases the telescopic elements to their maximum relative extent while ends of the spring act against said closure means to provide the bias to maximum extent. Preferably the maximum extended position, is limited by contact between said collars. The end closure means of the outer tubular member comprises an end cap having a threaded sleeve section which mates with a threaded portion at the end of said tubular element. The end cap on the outer tubular element is removeable to allow access to an interior passage in said device which receives the spring. The level of force resistance exerted by the device can be adjusted by substituting one biasing spring with another of a different compression resistance. Preferably the end closure means of the inner tubular member is provided with a threaded portion adapted to mate with an external thread on the outside of the inner tubular element; said threaded portion providing adjustment means to enable variation of length between said end closure means. The end closure means of said inner tubular member includes a threaded socket; the socket adapted for the attachment of a resilient support pad adapted to fit against the shoulder or hand of a user.

According to one embodiment the end closure means at the outward end of the outer tubular element is provided with a piston rod extending from the end closure means substantially the length of said outer tubular member. The piston rod terminates in a piston adapted for sliding in said inner tubular member and provides sealing of said telescopic elements.

According to a further embodiment, the inner tubular member includes an air flow control valve positioned at the outward end of the inner tubular member. The control valve is adapted to variably restrict the rate of air flow from said inner tubular member when said piston is driven towards said outward end of said tubular member. The end closure means may be provided with resilient pads with one provided with provided with strapping to secure the device to the wrist of a user.

According to a preferred but non limiting embodiment the overall length of said device when said outer and said inner tubular members are in a fully extended position is within in the range of 130 to 180 mm. According to a further embodiment the compression spring acts on a piston and piston rod coaxial with the tubular member so as to urge the piston and piston rod into a maximum extended position. An installed length of the compression spring is adjustable so as to vary a compressive force exerted by the spring on the piston and piston rod when the piston and piston rod are in a maximum extended position. According to one embodiment the tubular member is provided with a shoulder yoke, to support the device at the shoulder of a user and a wrist yoke at an outer end of the piston rod to provide support for the device at the wrist of the user. The shoulder yoke is provided with adjustment means adapted to vary the distance between the shoulder yoke and the wrist yoke, the wrist yoke provided with strapping means adapted to secure the yoke to the wrist of a user. Spring compression loadings required to compress the spring are in the range of 11 to 15 lb or 17 to 21 lb per inch of compression.

According to a broad form of a method aspect the present invention comprises:

a method for the exercise of the musculature of the upper arm, using a device comprising telescopically assembled co operating inner and outer tubular elements, each said tubular elements having end closure means at their outer ends; said outer tubular element including an inwardly projecting collar at its inward open end; said inner tubular element provided with an outwardly projecting collar at its inward open end; said collars co operating to prevent the withdrawal of said inner tubular element from said outer tubular element when said tubular elements operate telescopically; said method comprising including the steps of; (a) exerting an axial load on the device to induce compression in the device; such that the device resists rotational movement of a forearm towards an upper arm of the same arm, said resistance force acting along the line between the shoulder and the wrist of a user; (b) relaxing said axial load on said device so that said device restricts the angle at the elbow of said user to an angle about or less than 90 degrees; (c) adjusting said device so that the resistance force is within the capacity of the user to overcome by the rotational movement of the forearm towards the upper arm; said adjustment being effected by means of springs of varying spring rate or by means of varying the installed length of a compression spring; (d) repeated reciprocal rotational movements of the forearm towards the upper arm to exercise the arm of the user.

In a particular for a Velcro strap or equivalent releaseably connected device can be utilized to attach the device to the wrist of a user.

Preferably, said end closure means of said inner tubular member is provided with a threaded sleeve portion adapted to mate with an external thread on the outside of the inner tubular member; said threaded sleeve adapted to provide adjustment means to vary the length between the end closure means.

In a further broad form the invention comprises:

a device for the exercise of the musculature of the upper arm, said device providing a resistance force to the rotational movement about an elbow of the forearm towards an upper arm and wherein said rotational movement lies between the limits of approximately an angle of 90 degrees at the elbow and that angle between said forearm and said upper arm limited by contact between said forearm and said upper arm; the device including telescopically assembled inner and outer tubular elements, said tubular elements provided with end closure means at the outward ends of said tubular elements; the outer tubular element provided with an inwardly projecting collar at its inward open end; said inner tubular element provided with an outwardly projecting collar at its inward open end; said collars preventing the separation of the inner tubular element from the outer tubular element when the tubular elements are telescopically assembled.

Preferably, a compression spring is installed between said cap and the inwardly projecting collar of said inner tubular member; said spring providing an outward urging force biased to return said tubular members to a fully extended position.

In yet a further broad form of the invention, there is provided a method for the exercise of the musculature of the upper arm, said method including the steps of; (a) the use of an exercise device providing a resistance force to the rotational movement of the forearm towards the upper arm, said resistance force acting along the line between the shoulder and the wrist of a user; (b) adjusting said device so that when in a relaxed state said device restricts the angle at the elbow of said user to an angle equal to or less than 90 degrees; (c) adjusting said device so that the resistance force is within the capacity of the user to overcome in the rotational movement of the forearm towards the upper arm; said adjustment being effected by means of springs of varying spring rate or by means of varying the installed length of a compression spring; (d) repeated reciprocal rotational movements of the forearm towards the upper arm.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying illustrations, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

Embodiments of the present invention will now be described with reference to the accompanying drawings wherein.

DETAILED DESCRIPTION OF PREFERRED EMBODIMENTS

The examples referred to herein are illustrative and are not to be regarded as limiting the scope of the invention. While various embodiments of the invention have been described herein, it will be appreciated that these are capable of modification, and therefore the disclosures herein are not to be construed as limiting of the precise details set forth, but to avail such changes and alterations as fall within the purview of the description.

Figure 1:
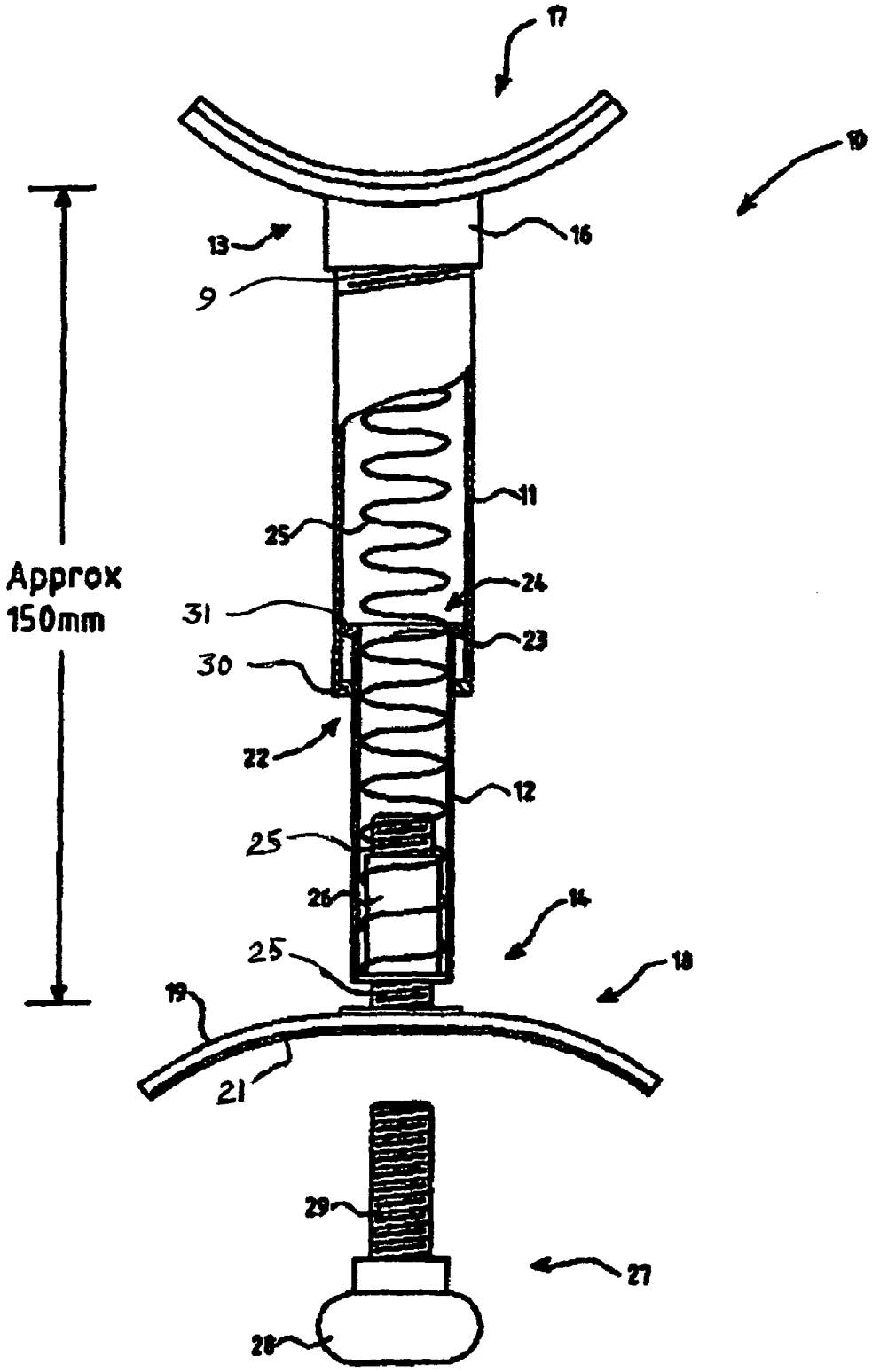
FIG. 1 is partially cut away perspective view of an exercise device according to one embodiment.

FIG. 1 shows a preferred embodiment of an exercise device 10 in which an outer tubular member 11 telescopically receives an inner tubular member 12. Both outer tubular member 11 and inner tubular masher 12 are closed at their opposite outer ends 13 and 14 respectively, with a closure of first outer end 13 comprising support element 17 including threaded cap 16 adapted to screw onto a threaded end portion 9 of the tubular member 11. Closure of the second outer end 14 incorporates a supporting element 18 comprising a curved saddle support 19 and a resilient cover 20 adapted to fit against the shoulder of a user. Supporting element 16 is provided with an internally threaded sleeve (not shown) mating with external threaded end portion 9 of the outer surface of outer tubular member 11, to provide access to replace the compression spring 24.

Supporting element 18 is further provided with a threaded socket 25 projecting into inner tubular member 12. Depending from threaded socket 25 is curved member 19 which engages a user's body via resilient pad 21. When fitted with alternative supporting element 18 device 10 may be operated between the two hands or between the hand and hip of a user, for example. Outer tubular member 11 is provided with an inwardly projecting retaining collar 30 at its open end 22. Likewise, inner tubular member 12 is provided with an outwardly projecting collar 31 at its open end 23, the collars 30 and 31 co operating to prevent the separation of inner tubular member 12 from outer tubular member 11 when the device 10 is assembled for use.

Compression spring 24 acts between the outer closed ends 13 and 14 of outer tubular member 11 and inner tubular member 12 respectively, so that the tubular members are naturally biased into a maximum extended state. Springs of various spring rates may be installed in the device substituted for spring 24 to provide different levels of user effort to force telescopic compression of inner tubular member 12 into outer tubular member 11. Fastener 27 includes head 28 and terminates in threaded region 29. Fastener can be used to secure the assembly at end 14.

A preferred arrangement of outer tubular member 11 and inner tubular member 12 allows for a reciprocating telescopic movement of compression and extension of the order of 75 mm. An important feature of the operation of the device is that it should be adjusted to suit a user so that it is the rotational limitation of the user's arm as the forearm contacts the bicep rather than the limit of travel of the telescoping elements of the device which defines the limit of compression stroke when the device is in use. When fully extended and placed between the wrist and the shoulder the adjusted length of the device should allow an angle at the elbow of approximately 90 degrees.

Figure 2:
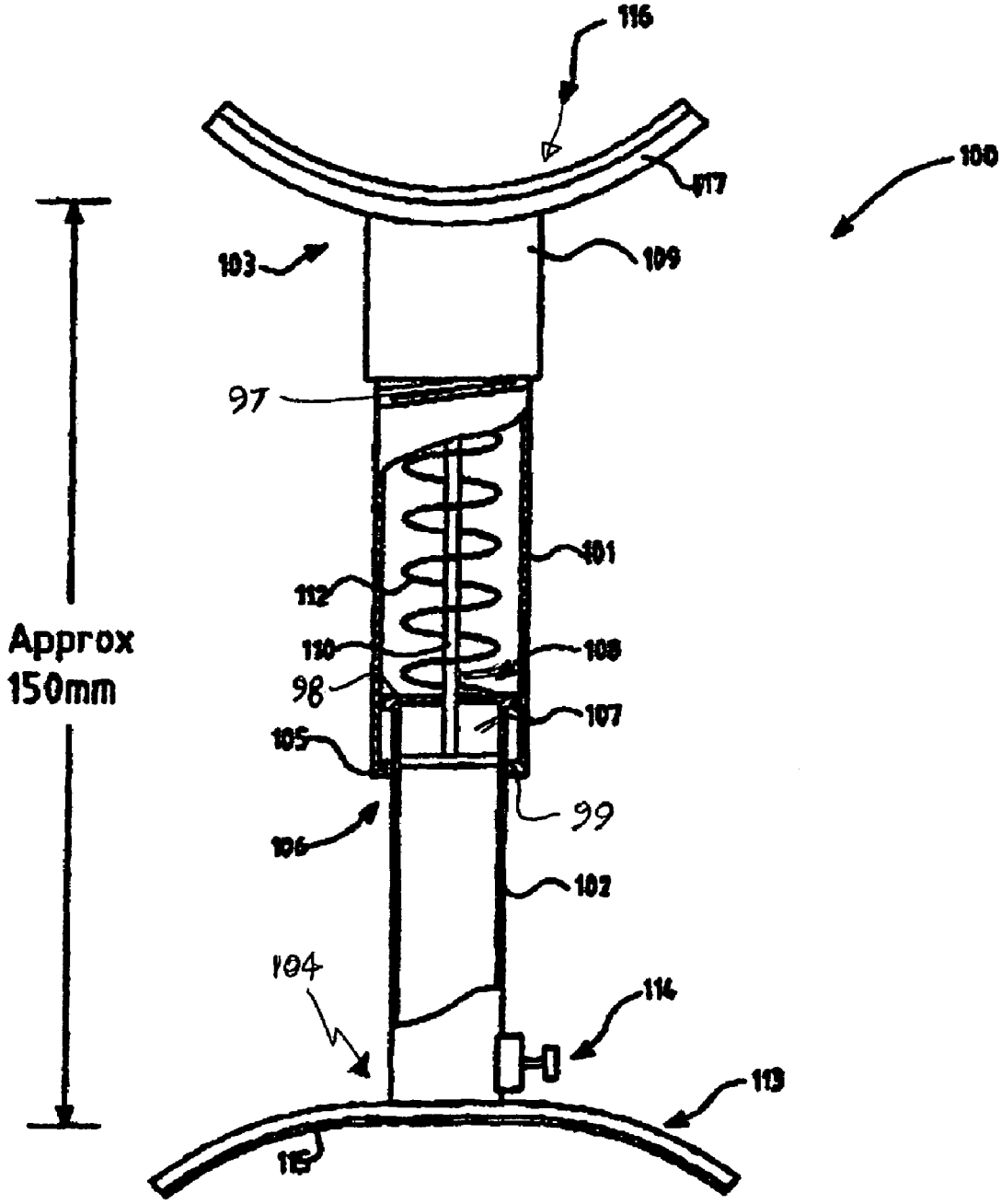
FIG. 2 is a partially cut away perspective view of an exercise device according to an alternative embodiment of the invention

FIG. 2 is a partially cut away perspective view of an exercise device 100 according to an alternative embodiment of the invention. In this embodiment, exercise device 100 has telescopically associated outer tubular member 101 and inner tubular member 102 closed at their outer ends by closure means 103 and 104 respectively.

Outer tubular member 101 is provided with an inwardly projecting retaining collar 99 at its open end 105. Likewise, inner tubular member 102 is provided with an outwardly projecting collar 98 at its end 106, the collars 98 and 99 adapted to prevent the separation of inner tubular member 102 from outer tubular member 101 when device 100 is assembled for use.

Closure 103 engages tubular member 101 via thread 97 and includes screw-on cap 109 which in turn is connected to a piston rod 110 ending in piston (obscured in screw cap 109.) Screw-on cap 109 is formed with an extended threaded sleeve section to allow for a range of adjustment in the position of cap 109 at the outer end 103 of outer tubular member 101. When the cap 109 is at a first engaged position, that is at its outermost location on outer tubular member 101, inner and outer tubular members 101 and 102 are at their maximum extension as allowed by their respective collars 98 and 99. Piston 107 is just located within the end 105 of inner tubular member 102. A compression spring 112 is adapted to act between cap 109 of the outer tubular member 101 and the outwardly projecting collar 98 of the inner tubular member 102 so as to urge the tubular members 101 and 102 into a maximum extended position. In this embodiment the force exerted by spring 112 is only sufficient to return the tubular members to that maximum extended-position.

Piston 107 is adapted to slide within inner tubular member 102 and is provided with sealing means to allow for the compression of the air column between the piston 107 and the closed outer end 104 of inner tubular member 102. Inner tubular member 102 is provided at its outer end 104 with flow restriction valve 114. Valve 114 is pro vided with control means whereby the rate of flow of air through the valve may be varied, thereby varying the amount of force required to drive piston 107 towards the end 104 of inner tubular member 102. The open end 105 of outer tubular member 101 may be provided with a slot (not shown) so as to accommodate flow restriction valve 114 when the device is driven to maximum compression.

Member 113 of inner tubular member 102 and support member 117 of cap 109 are provided with resilient pads 115 an 116 respectively. Optionally, cap 109 may be provided with a strap adapted to pass around the wrist of a user. As a further option, the device may be supplied with an interchangeable end pad in the form of a curved pad adapted to fit against the shoulder of a user.

Figure 3:
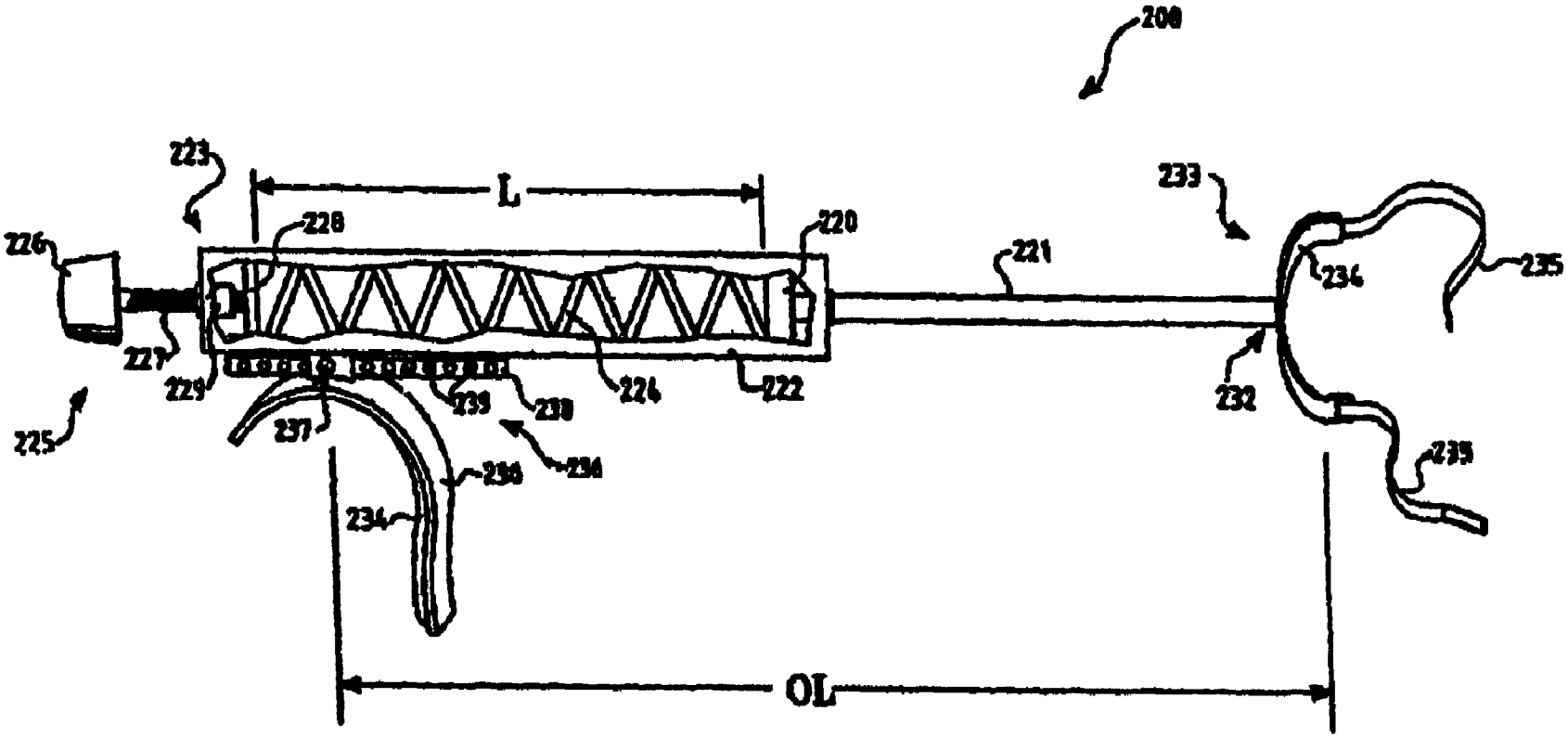
FIG. 3 is a partially cut away side view of an exercise device according to a further embodiment.

FIG. 3 is a partially cut away side view of an exercise device 200 according to a further embodiment. Exercise device 200 comprises a piston 220 and piston rod 221 telescopically sliding in tubular member 222. Located inside tubular member 222 between a first end 223 of tubular member 222 an the piston 220 is a compression spring 224 so disposed as to provide an outwardly urging force to the piston 220 and piston rod 221. First end 223 of tubular member 222 is provided with spring compression adjustment assembly 225 so as to vary the urging force of spring 224 on piston 220 and piston rod 221. Spring compression adjustment means 225 comprises an adjustment knob 226, threaded shaft 227 and adjustment piston 228. Rotation of adjustment knob 226 causes axial displacement of adjustment piston 228 as threaded shaft 227 rotates in threaded bush 229 fixed in first tubular member end 223, thereby modifying the installed length 'L' of compression spring 224 and the compression force required to urge piston rod 221 and piston 220 inwardly.

Figure 4:
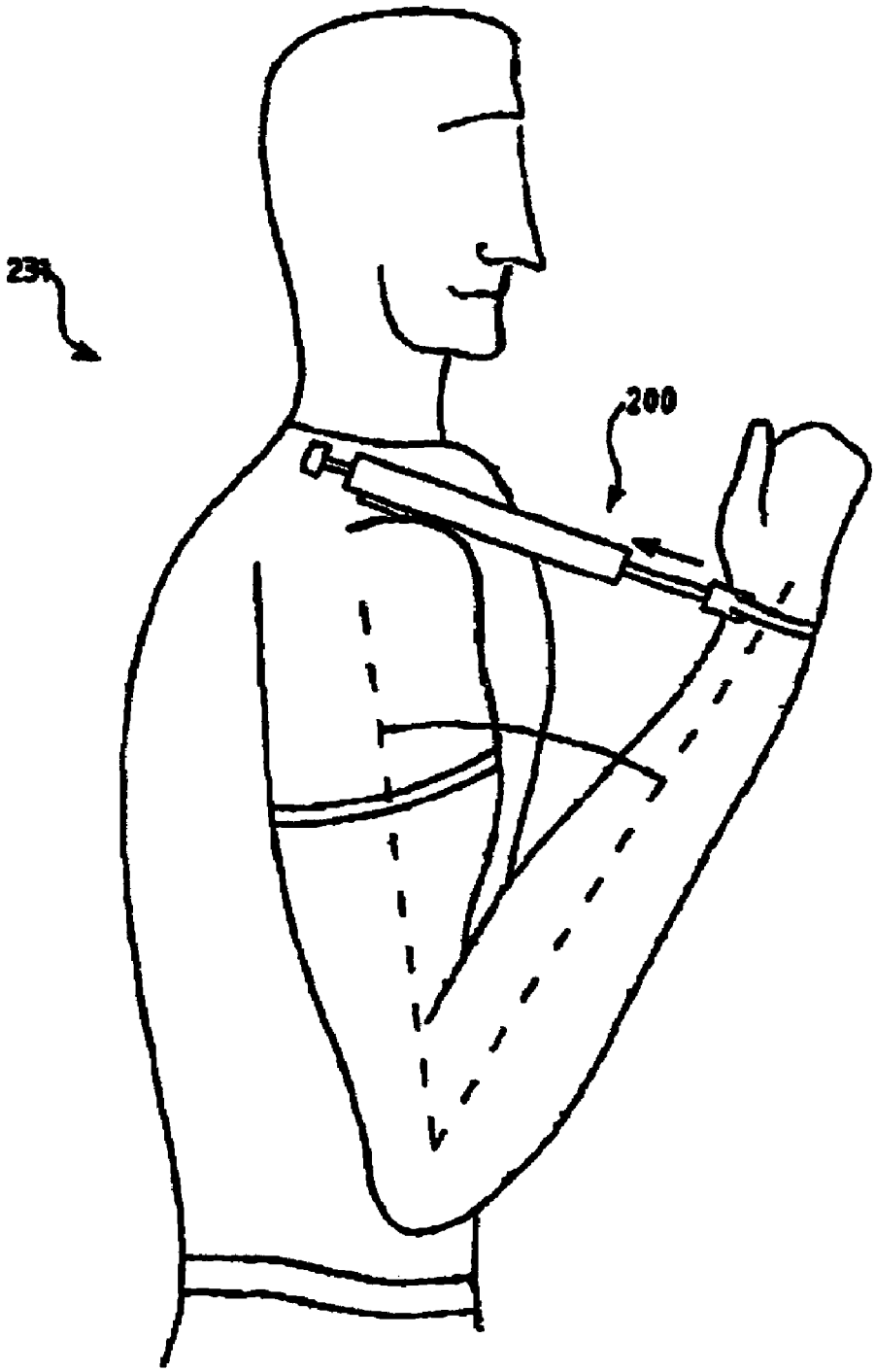
FIG. 4 is a view of the device of FIG. 3 in use.

Attached towards first end 223 of tubular member 222 is shoulder yoke 230 adapted to fit against the shoulder of a user 231 as shown in FIG. 4. Similarly, at outer end 232 of piston rod 221 is wrist yoke 233. Both shoulder yoke 230 and wrist yoke 233 are provided with resilient pads 234 for the comfort of the user 231. In a preferred embodiment wrist yoke 233 is provided with securing strap 235 adapted to loop around the wrist of user 231. Preferably securing strap 235 is provided with self securing surface means such as Velcrose strips so as to provide convenient variable adjustment of the strap around the wrist of a user.

In a further preferred embodiment the device is provided with adjustment means 236 so that the position of shoulder yoke 230 is adjustable between a first position adjacent to first end 223 of tubular member 222 and selectable positions 237 along a portion of the length of the tubular member. This enables the overall length 'OL' between the shoulder yoke and the wrist yoke to be varied to suit the preference and the size of a particular user and adapt the device to its intended range of movement, that is the pivotal movement of the forearm relative to the upper arm through an acute angle. By way of example, the adjustment means may consist of a length of adjusting rail 238 attached to the underside of tabular member 222, the rail provided with a series of discreet holes 239 allowing the shoulder yoke to be secured at any selected hole position, for example by a detent pin. In use, the device is adjusted so as to define a distance 'L' between shoulder yoke 230 and wrist yoke 233 to suit a particular user. Distance 'L' should be such as to restrict the angle .alpha. where .alpha.=/<90.degree. at the elbow when the device is in a relaxed state. After adjusting the compression force of compression spring 224 positioning the device between shoulder and wrist, the user rotates the forearm so as to reduce the distance 'L' to approximately L/2 at the point where further rotation of the elbow is prevented by contact of the forearm with the bicep.

An exercise session then consists of a series of oscillating movements with the forearm between the relaxed state approximately defined by distance 'L' and the compressed state defined approximately by the distance 'L/2', or alternatively defined as rotation of the forearm relative to the upper arm between a first angle 'α' and second angle equal to or less than 'α/2'.

Normally an inexperienced user will start an exercise regime with the compression of spring 224 set to its maximum installed length (thus at its minimum outwardly urging force), gradually increasing the compression as the musculature of the upper arm develops.

In a further preferred embodiment the should and wrist yokes are adapted to be detachable from the device to allow the yokes to be replaced by suitable handgrips. In this configuration the device may be used to exercise the shoulder muscles by grasping the device by the handgrips, one in each hand, and applying compressive force.

EXAMPLE

Electrodes were positioned over four muscles (biceps brachii, medial triceps brachii, petoralis major and latissimus dorsi) of one male subject to measure activation levels during use of the exercise device.

Test A: The first task that was performed involved elbow flexion while the shoulder was flexed to maintain a horizontal position of the upper arm. In this position, while the device was held fin the hand and pressed down onto the shoulder, muscle activation of the biceps brachii was monitored.

Test B: For the next task the subject positioned his arm by his side and adducted the shoulder against the resistance of the exercise device. The exercise device was held in the hand and squeezed against the thigh, muscle activation of the pectoralis major, triceps brachii (medial head) and latissimus dorsi were monitored during this task.

Test C: The final task involved the horizontal adduction of the shoulder. Both arms were flexed and held in a horizontal position in front of the subject while the exercise device was pushed together between the hands. Muscle activation of the pectoralis major, triceps brachii (medial head) and latissimus dorsi were monitored in this test.

For all tests two static and two dynamic trials were performed and in each case the average activation of the two trials was calculated. First A was performed with a light and a heavy spring while only a light spring was used for Tests B and C.

Muscle activation levels were normalized to a percentage of the subject's isometric (static) maximal voluntary contraction (MVC) against an immobile load for 3 seconds. Normalization of the trial data involved dividing the average trial data by the MVC and then multiplying by 100 to produce a percentage of the MVC. In all tests the MVC was performed in the same position as the task, however for Test A an additional MVC was performed at 90° flexed elbow position to compare the test results with a common biceps brachii flexing exercise position.

RESULTS

Table 1 lists the muscle activation level results as a percentage of MVC for each test.

Table 1. Results for tests A, B and C. For test A the "standard" data indicated the comparison with the MVC taken in the same position as the test and "90°" represents the comparison with the MVC taken at 90° of flexion.

| Test | Spring Resistance | Static (% MVC) | | Dynamic (% MVC) | |
|---|---|---|---|---|---|
| MVC | | Standard | 90° | Standard | 90° |
| A - Elbow | Light | 30.5 | 25.2 | 96.2 | 79.5 |
| Flexion | Heavy | 217.8 | 180.0 | 165.7 | 137.0 |

| Test | Muscles | Static (% MVC) | Dynamic (% MVC) |
|---|---|---|---|
| B - Adduction | Triceps Brachii (medial head) | 96.0 | 71.0 |
| | Latissimus dorsi | 187.5 | 160.3 |
| | Pectoralis major | 83.5 | 68.9 |
| C - Horizontal Adduction | Triceps Brachii (medial head) | 14.3 | 14.1 |
| | Latissimus dorsi | 45.4 | 55.6 |
| | Pectoralis major | 149.5 | 121.7 |

Overall, the results indicate that apart from the low activation level of the triceps brachii in Test C all muscles have shown a substantial level of activation in each test, see Table 1. In Test A (elbow flexion) the use of the light spring has shown a reasonable level of muscle activation. The use of the heavy spring has produced much greater activation, while performing dynamic activity has had a varied effect. During Test B (shoulder adduction), the latissimus dorsi has shown substantially greater activity than the other two muscles. The static trials have produced greater activation than the dynamic trials for Test B. In Test C, the pectoralis major has shown much greater activity than the latissimus dorsi and triceps. In this test, the differences between the static and dynamic results carried once again.

SUMMARY

During an elbow flexion exercise the spring loaded exercise device has show biceps brachii muscle activation that reaches and sometimes exceeds a level equivalent to a standard 90° flexed elbow position action. During shoulder adduction, activation of the latissimus dorsi was the dominant muscle activated, while during horizontal adduction activation of pectoralis major was dominant.

The above describes only some embodiments and uses of the present invention and modifications and adaptations, obvious to those skilled in the art, can be made thereto without departing from the scope and spirit of the invention.

The invention claimed is:

1. A device for the exercise of the musculature of the upper arm, the device comprising: telescopically assembled co operating inner and outer tubular elements, each said tubular elements having end closure means at their outer ends; said outer tubular element including an inwardly projecting collar at its inward open end;

said inner tubular element provided with an outwardly projecting collar at its inward open end; said collars co operating to prevent the withdrawal of said inner tubular element from said outer tubular element when said tubular elements operate telescopically;

said device moveable between a first state in which the telescopic elements are fully extended and a second state in which the telescopic elements are compressible against a bias inside the device to provide a resistance force to rotational movement about the elbow of a forearm in a direction towards an upper arm of the same arm; wherein the device is of a length which allows engagement of one end with a hand of a user and the other end with an upper part of the same arm such that the user can exercise one arm by urging the hand against the upper arm without use of the other arm; wherein said rotational movement extends between the limits of approximately an angle of 90 degrees formed by the forearm and upper arm and a smaller angle between said forearm; said upper arm limited by contact between said forearm and said upper arm and wherein the bias is a compression spring which naturally biases the telescopic elements to their maximum relative extent; wherein, ends of said spring act against said closure means to provide the bias to maximum extent; said maximum extended position is limited by contact between said collars; said end closure means of said outer tubular member comprising an end cap having a threaded sleeve section which mates with a threaded portion at the end of said tubular element and which is removeable to allow access to an interior passage in said device which receives the spring; wherein, the level of force resistance exerted by the device can be adjusted by substituting one biasing spring with another of a different compression resistance; wherein, said end closure means of said inner tubular member is provided with a threaded portion adapted to mate with an external thread on the outside of said inner tubular element; said threaded portion providing adjustment means to enable variation of length between said end closure means; said end closure means of said inner tubular member including a threaded socket; said socket adapted for the attachment of a resilient support pad adapted to fit against the shoulder or hand of a user; said end closure means at the outward end of said outer tubular element is provided with a piston rod extending from said end closure means substantially the length of said outer tubular member.

2. A device according to claim 1 wherein said piston rod terminates in a piston adapted for sliding in said inner tubular member.

3. A device according to claim 2 wherein the piston provides sealing of said telescopic elements.

4. A device according to claim 3 wherein the compression spring is installed between said end cap and the inwardly projecting collar of said inner tubular member.

5. A device according to claim 4 wherein, said inner tubular member includes an air flow control valve positioned at said outward end of said inner tubular member.

6. A device according to claim 5 wherein, said air control valve is adapted to variably restrict the rate of air flow from said inner tubular member when said piston is driven towards said outward end of said tubular member.

7. A device according to claim 6 wherein said end closure means are provided with resilient pads.

8. A device according to claim 7 wherein one of said end closure means is provided with strapping to secure the device to the wrist of a user.

9. A device according to claim 8 wherein the overall length of said device when said outer and said inner tubular members are in a fully extended position is within in the range of 130 to 180 mm.

10. A device according to claim 9 wherein said compression spring acts on a piston and piston rod coaxial with said tubular member so as to urge said piston and said piston rod into a maximum extended position.

11. A device according to claim 10 wherein an installed length of said compression spring is adjustable so as to vary a compressive force exerted by said spring on said piston and said piston rod; wherein said installed length is the length of said spring when said piston and said piston rod are in said maximum extended position.

12. A device according to claim 11 wherein said tubular member is provided with a shoulder yoke, to support said device at the shoulder of a user; and a wrist yoke at an outer end of said piston rod to provide support for said device at the wrist of said user.

13. A device according to claim 12 wherein said shoulder yoke is provided with adjustment means adapted to vary the distance between said shoulder yoke and said wrist yoke.

14. A device according to claim 13 wherein, said wrist yoke is provided with strapping means adapted to secure said yoke to the wrist of a user.

15. A device according to claim 14 wherein spring compression loadings required to compress the spring are in the range of 11 to 15 lb per inch of compression.

16. A device according to claim 14 wherein spring compression loadings required to compress the spring are in the range of 17 to 21 lb per inch of compression.

17. A method for the exercise of the musculature of the upper arm, using a device comprising: telescopically assembled co operating inner and outer tubular elements, each said tubular elements having end closure means at their outer ends;

said outer tubular element including an inwardly projecting collar at its inward open end; said inner tubular element provided with an outwardly projecting collar at its inward open end; said collars co operating to prevent the withdrawal of said inner tubular element from said outer tubular element when said tubular elements operate telescopically; said method comprising including the steps of; (a) exerting an axial load on the device to induce compression in the device; such that the device resists rotational movement of a forearm towards an upper arm of the same arm, said resistance force acting along the line between the shoulder and the wrist of a user;

(b) relaxing said axial load on said device so that said device restricts the angle at the elbow of said user to an angle about or less than 90 degrees;

(c) adjusting said device so that the resistance force is within the capacity of the user to overcome by the rotational movement of the forearm towards the upper arm; said adjustment being effected by means of springs of varying spring rate or by means of varying the installed length of a compression spring;

(d) repeated reciprocal rotational movements of the forearm towards the upper arm to exercise the arm of the user.

* * * * *